US008970440B2

(12) United States Patent
Miyata

(10) Patent No.: US 8,970,440 B2
(45) Date of Patent: Mar. 3, 2015

(54) WAVEGUIDE/PLANAR LINE CONVERTER

(75) Inventor: Akira Miyata, Tokyo (JP)

(73) Assignee: NEC Corporation, Tokyo (JP)

( * ) Notice: Subject to any disclaimer, the term of this patent is extended or adjusted under 35 U.S.C. 154(b) by 679 days.

(21) Appl. No.: 13/143,442

(22) PCT Filed: Jan. 19, 2010

(86) PCT No.: PCT/JP2010/050574
§ 371 (c)(1),
(2), (4) Date: Jul. 13, 2011

(87) PCT Pub. No.: WO2010/082668
PCT Pub. Date: Jul. 22, 2010

(65) Prior Publication Data

US 2011/0267249 A1 Nov. 3, 2011

(30) Foreign Application Priority Data

Jan. 19, 2009 (JP) ..... 2009-008868

(51) Int. Cl.
*H01Q 13/00* (2006.01)

(52) U.S. Cl.
USPC ..... 343/772; 343/700 MS

(58) Field of Classification Search
USPC ..... 343/700 MS, 795, 846, 905, 772
See application file for complete search history.

(56) References Cited

U.S. PATENT DOCUMENTS 7,675,466 B2 * 3/2010 Gaucher et al. ..... 343/700 MS

FOREIGN PATENT DOCUMENTS

| | | | |
|---|---|---|---|
| JP | 8-139504 | A | 5/1996 |
| JP | 2002500840 | A | 1/2002 |
| JP | 2004187281 | A | 7/2004 |
| JP | 2005039414 | A | 2/2005 |
| JP | 2006262138 | A | 9/2006 |

OTHER PUBLICATIONS

International Search Report for PCT/JP2010/050574 mailed Apr. 27, 2010.

* cited by examiner

*Primary Examiner* — Karl D Frech
(74) *Attorney, Agent, or Firm* — Sughrue Mion, PLLC

(57) ABSTRACT

A waveguide/planar line converter (1) has a rectangular-tube-shaped waveguide (3) through which microwaves or millimeter waves are electrically transmitted, and a planar line substrate (7), which is attached to the opening end portion (5) of the waveguide (3) and amplifies the waves and converts the frequencies of the waves. The planar line substrate (7) has a first conductor layer (9) having the waveguide (3) connected thereto, a second conductor layer (11), and a dielectric body (13) arranged between the conductor layers. The first conductor layer (9) has an antenna pattern (15) and a first grounding conductor (17) arranged on the circumference of the antenna pattern (15) The second conductor layer (11) has a strip conductor (19) electrically connected to the antenna pattern (15), and a second grounding conductor (21) electrically connected to the first grounding conductor (17). A pair of antenna patterns (15) are arranged to the waveguide (3) such that the position and the direction of the electric field generated between the antenna patterns accord with the position and the direction of the maximum electric field inside of the waveguide (3).

9 Claims, 12 Drawing Sheets

35

C
3
B
B
4
5
C
15
15
9
D
17
25
D
GA
25
13
7
11
19
21

53

C
3
B
B
4
5
C
15
15
9
D
D
17
25
GA
23
25
13
7
11
19
21
55

WAVEGUIDE/PLANAR LINE CONVERTER

TECHNICAL FIELD

The present invention relates to a waveguide/planar line converter, and more specifically to a waveguide/planar line converter provided with a waveguide through which microwaves or millimeter waves are electrically transmitted, and a planar line substrate for amplifying or converting the frequency of these waves.

BACKGROUND ART

In order to amplify microwaves or millimeter waves electrically transmitted through a waveguide, or in order to convert the frequency thereof, a waveguide/planar line converter is provided in an interface unit joining a waveguide and a planar line circuit.

Patent Literature 1 discloses a waveguide/planar line converter including a cylindrical waveguide and a planar line substrate furnished on this waveguide.

The planar line substrate includes a laminated structure in the vertical direction. The top layer of the planar circuit substrate is formed in a frame shape compatible with the opening end in the waveguide, and includes a first grounding conductor to which the opening end of this waveguide is adhered and anchored to, and an antenna pattern positioned within the frame of this grounding conductor which comprises a $\lambda/2$ resonant antenna.

In addition, the bottom layer of the planar line substrate includes a strip conductor the tip of which extends as far as a position opposite the antenna pattern, and a second grounding conductor positioned surrounding this strip conductor.

PRIOR ART LITERATURE

Patent Literature

Patent Literature 1: Unexamined Japanese Patent Application KOKAI Publication No. H08-139504

SUMMARY OF INVENTION

Problems to be Solved by the Invention

With the waveguide/planar line converter noted in Patent Literature 1, an electric field is generated inside the waveguide when electrically transmitting via the waveguide. At such times, the position of the maximum electric field inside the waveguide is on the center line of the waveguide in the direction of width, and the direction of this maximum electric field is a direction facing from one side to the other side in this center line and is orthogonal to the direction in which the planar line substrate is laminated. On the other hand, at this time an electric field is generated near the edge of the antenna pattern in the planar line substrate in the direction in which the planar line substrate is laminated. Because this electric field has a direction differing from the aforementioned maximum electric field generated inside the waveguide, the joining of the electromagnetic field distribution caused by the antenna pattern and the electromagnetic field distribution caused by the waveguide is suppressed. Through this, the conversion properties of the waveguide/planar line converter deteriorate.

In consideration of the foregoing, it is an object of the present invention to provide a waveguide/planar line converter having superior conversion properties.

Means for Solving the Problem

In order to achieve the above object, the waveguide/planar line converter according to the present invention comprises a waveguide and a planar line substrate to which an opening end of the waveguide is adhered and anchored; wherein a pair of antenna patterns is positioned facing each other with a gap in between, surrounding the opening end of the waveguide on the planar line substrate; and the waveguide and the pair of antenna patterns are positioned such that the position and direction of an electric field generated between the pair of antenna patterns match the position and direction of the maximum electric field inside the waveguide.

Effect of the Invention

With the present invention, the position and direction of the electric field generated between a pair of antenna patterns match the position and direction of the electric field generated inside the waveguide, so joining of the electromagnetic field distribution caused by the antenna patterns and the electromagnetic field distribution caused by the waveguide is easy. Through this, superior conversion properties can be obtained.

BEST MODE FOR CARRYING OUT THE INVENTION

Figure 1:
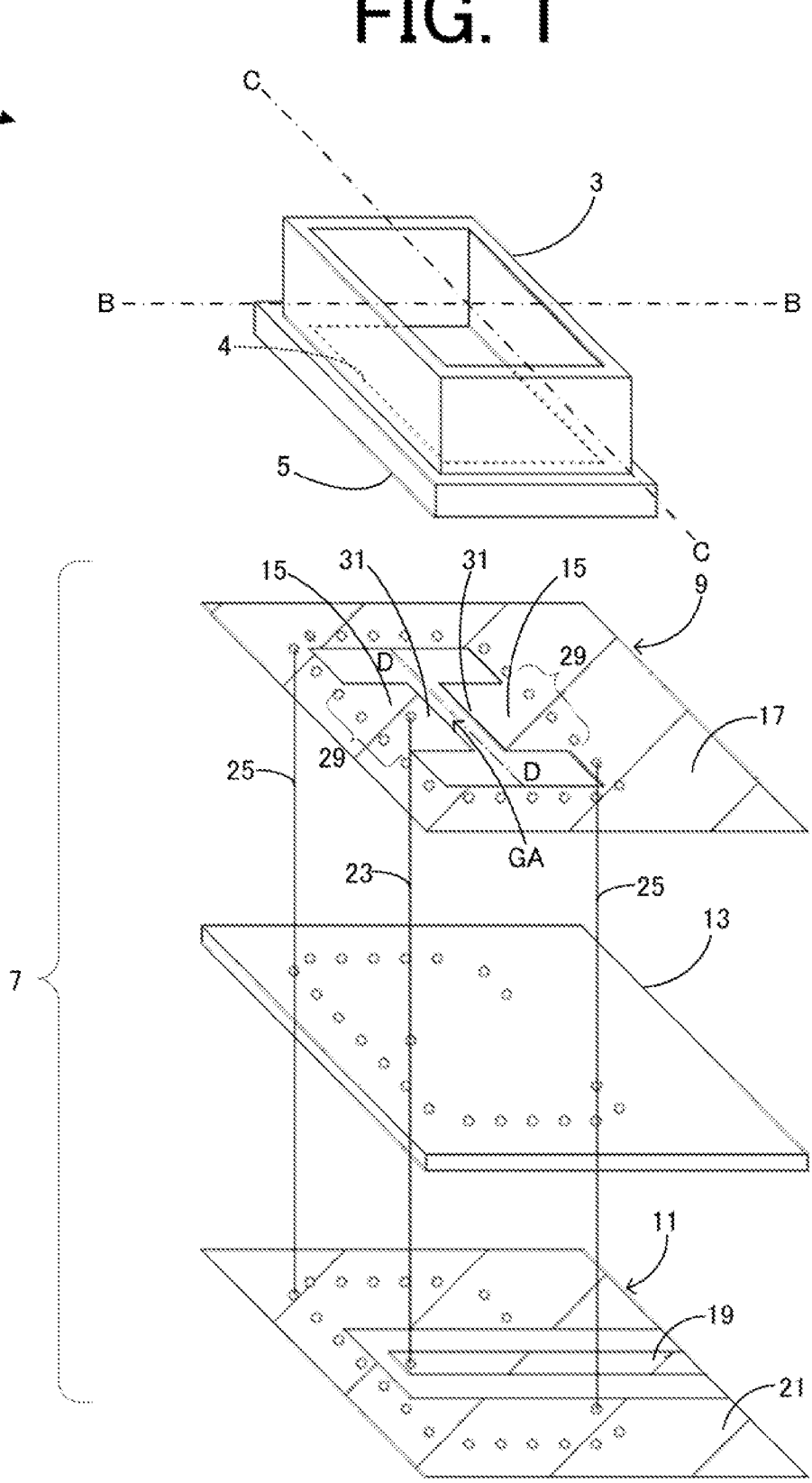
FIG. 1 is an exploded oblique view of a waveguide/planar line converter according to a first embodiment.

Below, the preferred embodiments of the present invention are described in detail with reference to the drawings. The same reference numbers are appended to the same or corresponding parts in the drawings.

FIG. 1 is an exploded oblique view of a waveguide/planar line converter 1 according to a first embodiment. FIG. 1 shows with hatching solid parts in a first conductor layer 9 and a second conductor layer 11 in order to distinguish between solid parts and empty space (such as bored out parts). The same is true in the drawings below as well.

The waveguide/planar line converter 1 includes a rectangular-tube-shaped waveguide 3 through which microwaves or millimeter waves are electrically transmitted, and a planar line substrate 7 which is attached to the opening end 5 of the waveguide 3 and which accomplishes amplification and frequency conversion on these waves. Here, a direction parallel to the long axis of the opening end 5 of the waveguide 3 shall be called the widthwise direction, a direction parallel to the short axis thereof shall be called the heigthwise direction and the direction in which the waveguide 3 extends shall be the vertical direction.

The planar line substrate 7 is a thin plate comprising a first conductor layer 9 to which the waveguide 3 is connected, a second conductor layer 11 and a dielectric body 13 as an intermediate layer positioned between these two. Here, these layers are laminated in the vertical direction and bonded into a single body. The first conductor layer 9 and the second conductor layer 11 comprise a below-described pair of antenna patterns and a planar line connected to these antenna patterns.

Figure 2:
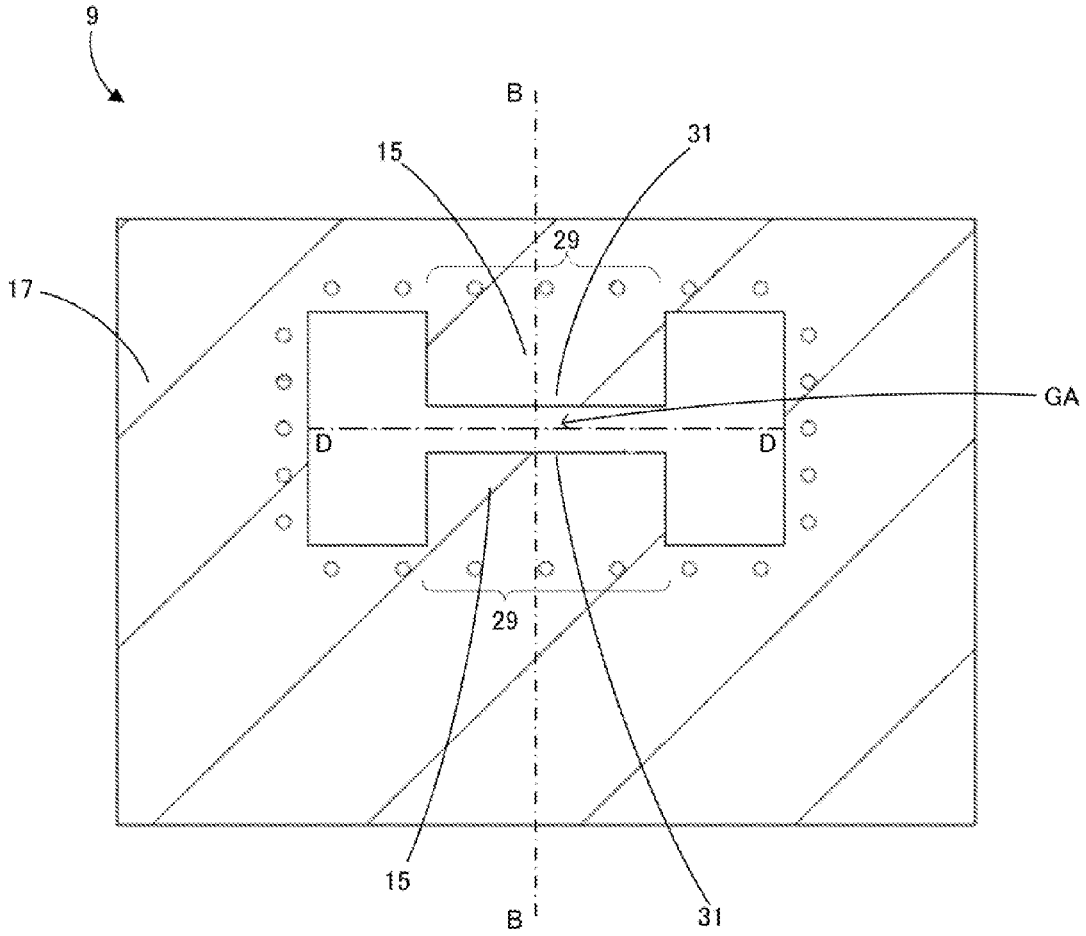
FIG. 2 is a planar view of a first conductor layer according to the first embodiment.

FIG. 2 is a planar view of the first conductor layer according to the first embodiment.

The first conductor layer 9 is composed of a conductive thin film such as copper thin film, for example, and functions as a conductor-backed coplanar line. The first conductor layer 9 includes a pair of antenna patterns 15 and a first grounding conductor 17. The pair of antenna patterns 15 is composed of two rectangular conductors arranged line-symmetrically with a prescribed gap GA positioned inside the opening end 5 of the waveguide 3. The first grounding conductor 17 is positioned around the pair of antenna patterns 15 and is adhered and anchored to the opening end 5 of the waveguide 3.

Figure 3:
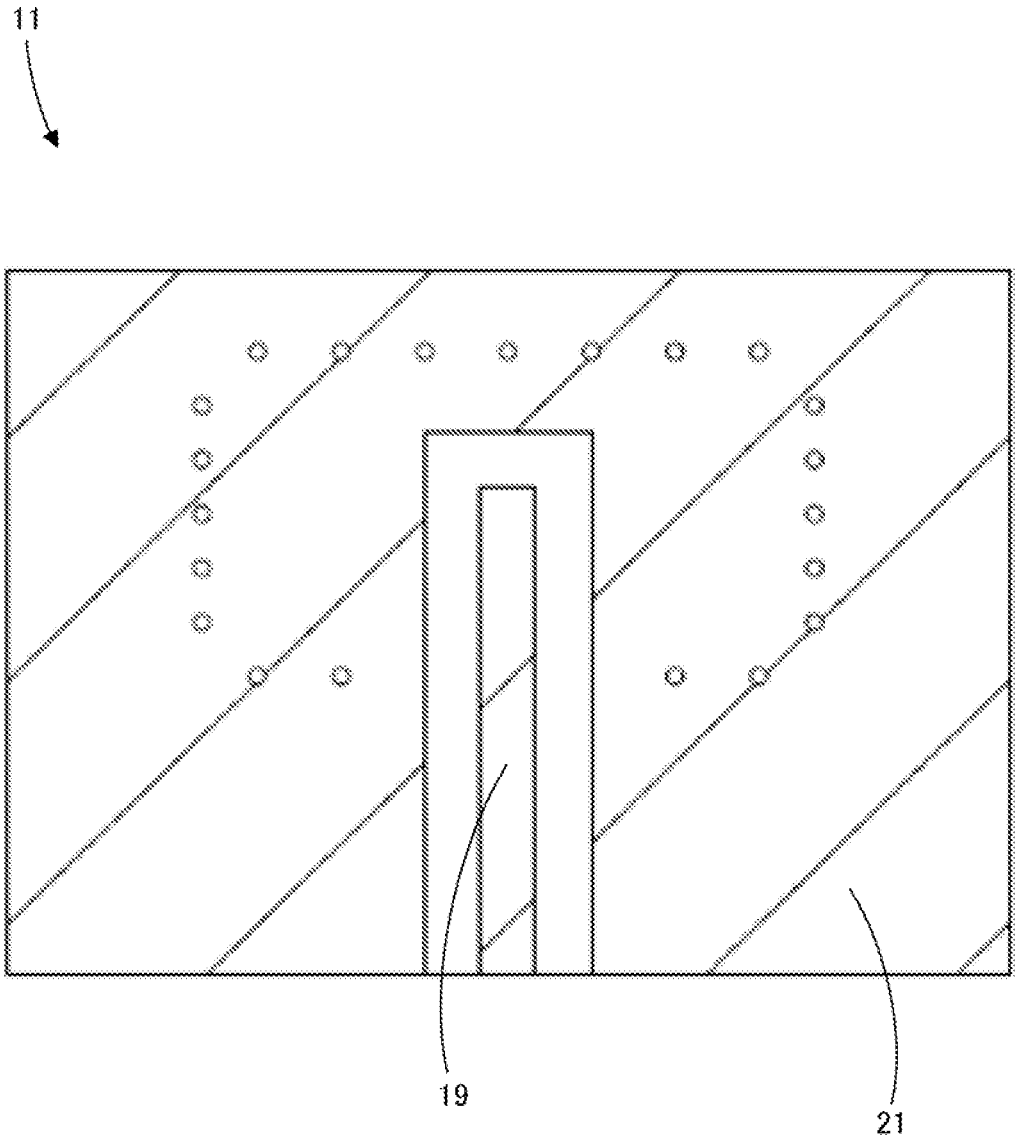
FIG. 3 is a planar view of a second conductor layer according to the first embodiment.

FIG. 3 is a planar view of the second conductor layer 11 according to the first embodiment.

The second conductor layer 11 is composed of a conductor thin film such as a copper thin film, for example, and functions as a coplanar line. The second conductor layer 11 includes a strip conductor 19 and a second grounding conductor 21. The strip conductor 19 extends in a direction in which the antenna patterns 15 are lined, and faces each of the antenna patterns 15. In addition, the strip conductor 19 is electrically connected to the antenna patterns 15 through via holes 23 passing through the dielectric body 13 in the direction of depth and being filled inside with a conductor. The second grounding conductor 21 is positioned around the strip conductor 19 and is electrically connected to the first grounding conductor 17 by via holes 25 passing through the dielectric body 13 in the direction of depth and filled inside with a conductor as similar to the via holes 23.

As shown in FIGS. 1 and 2, the pair of antenna patterns 15 contact the part 29 overlapping the strip conductor 19 out of the junctions with the opening end 5 of the waveguide 3 and the first grounding conductor 17, and the open ends 31 face each other with the gap GA interposed in between. Each of antenna patterns 15 in a pair comprises a $\lambda/4$ resonant antenna. Here, the resonant frequencies of these differ.

When electrically transmitting via the waveguide 3, the position where the electric field inside the waveguide 3 is a maximum is on the center line B in the direction of width inside the waveguide 3, and the direction of that maximum electric field is in the direction facing from one side to the other side on the center line B. In addition, with the planar line substrate 7, between the pair of antenna patterns 15 (in other words, in the gap GA), an electric field directing from one antenna pattern 15 to the other antenna pattern 15 is generated by antenna coupling. In the present embodiment, the antenna patterns 15 are positioned such that the center line B of the waveguide 3 and the gap GA overlap. As a result, the position and direction of the electric field generated between the pair of antenna patterns 15 (in the gap GA) match the position and direction of the maximum electric field generated inside the waveguide 3.

With the present embodiment, because the position and direction of the electric field generated between the pair of antenna patterns 15 as described above match the position and direction of the electric field generated inside the waveguide 3, bonding between the electromagnetic field distribution from the antenna patterns 15 and the electromagnetic field distribution from the waveguides 3 becomes easy. Through this, a high conversion efficiency is obtained and conversion properties excel.

In addition, the antenna patterns 15 comprise $\lambda/4$ resonant antennas, so cross-polarized waves are theoretically not generated. For the same reason, even when symmetry in the shape of the antenna patterns 15 is lost due to manufacturing discrepancies, such as etching, generation of cross-polarized waves can be suppressed. In this manner, generation of electric power not coupled to the waveguide 3 or the strip conductor 19 from the antenna patterns 15 can be suppressed, so the waveguide/planar line converter 1 has reduced property deterioration caused by cross-polarized waves, and frequency properties excel.

In addition, the pair of antenna patterns 15 comprises resonant antennas whose resonant frequencies differ, so it is possible to cause double resonance neighboring the passthrough band of the resonant antennas. Through this, the bandwidth of the waveguide/planar line converter 1 becomes large compared to single resonance.

As explained above, with the present embodiment the pair of antenna patterns 15 is positioned facing each other with a gap GA inside the end 5 of the rectangular opening 4 of the waveguide 3, as shown in FIGS. 1 to 3. The open ends of the pair of antenna patterns 15 face each other with the gap GA interposed in between. The gap GA is formed at a position where the center line D in the direction of height overlaps the center line C in the direction of height of the waveguide 3. In addition, the pair of antenna patterns 15 is formed in a line-symmetrical shape centered on the center line D. Furthermore, the pair of antenna patterns 15 is formed at a position overlapping the center line B.

Next, second through seventh embodiments differing from the first embodiment will be described. Below, differences from the first embodiment and are mainly explained, and the same reference numbers are attached to common structures.

Figure 4:
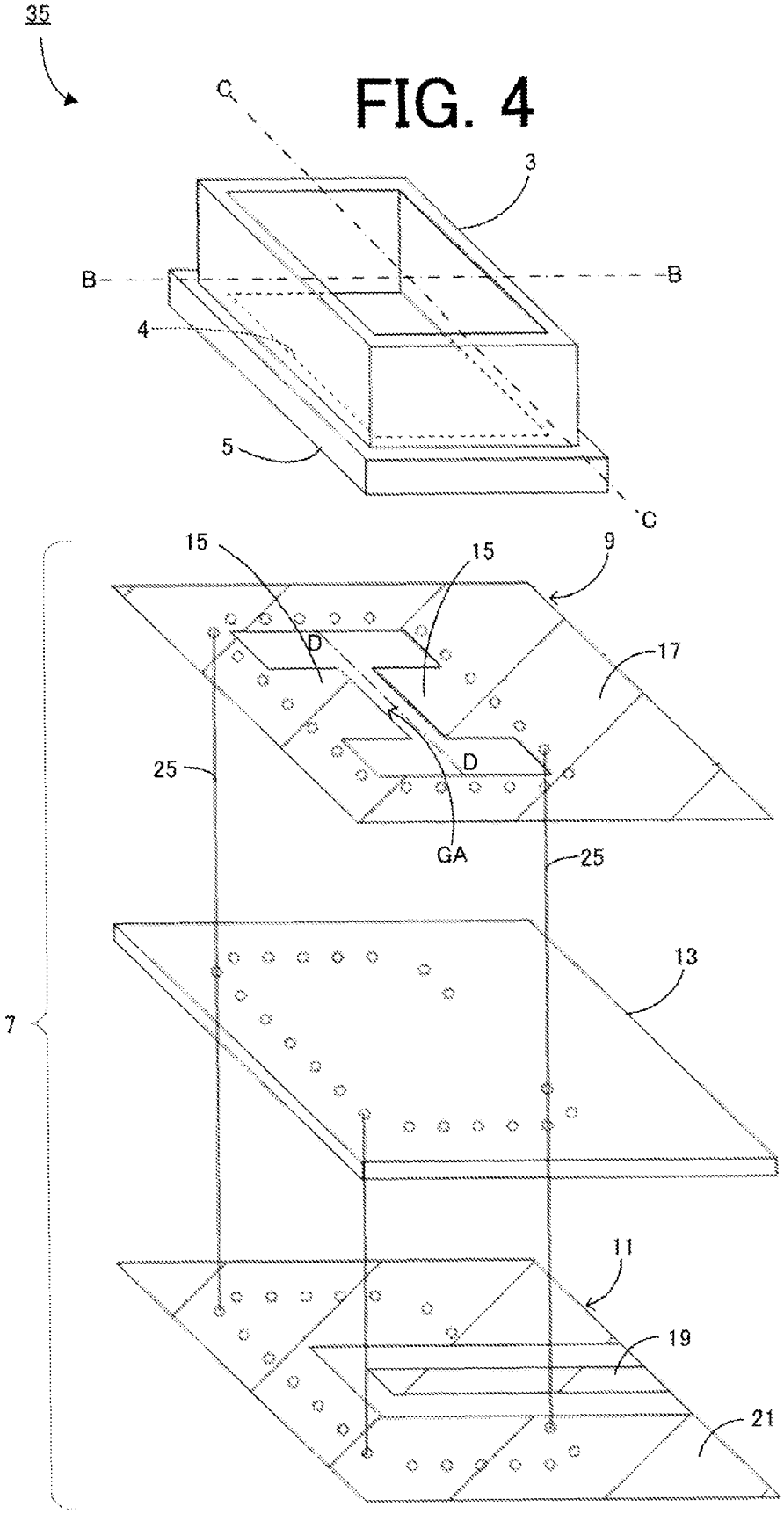
FIG. 4 is an exploded oblique view of the waveguide/planar line converter according to a second embodiment.

FIG. 4 is an exploded oblique view of the waveguide/planar line converter 35 according to a second embodiment.

In this embodiment, the via holes 23 shown in the first embodiment are omitted. The tip of the strip conductor 19 is an open end, and near the tip of the strip conductor 19 and one of the antenna patterns IS are electrically connected by a capacitance coupling. For parts where the capacitance bond is to be avoided, for example, the linewidth of the strip conductor 19 may be made finer or the dielectric constant of the dielectric body may be made lower than the surroundings.

With the present embodiment, it is possible to electrically connect the antenna patterns 15 and the strip conductor 19 without needing via holes. Through this, aligning the positions of the antenna patterns 15, the strip conductor 19 and the via holes 25 becomes unnecessary, which is advantageous in terms of reducing variance in manufacturing.

Figure 5:
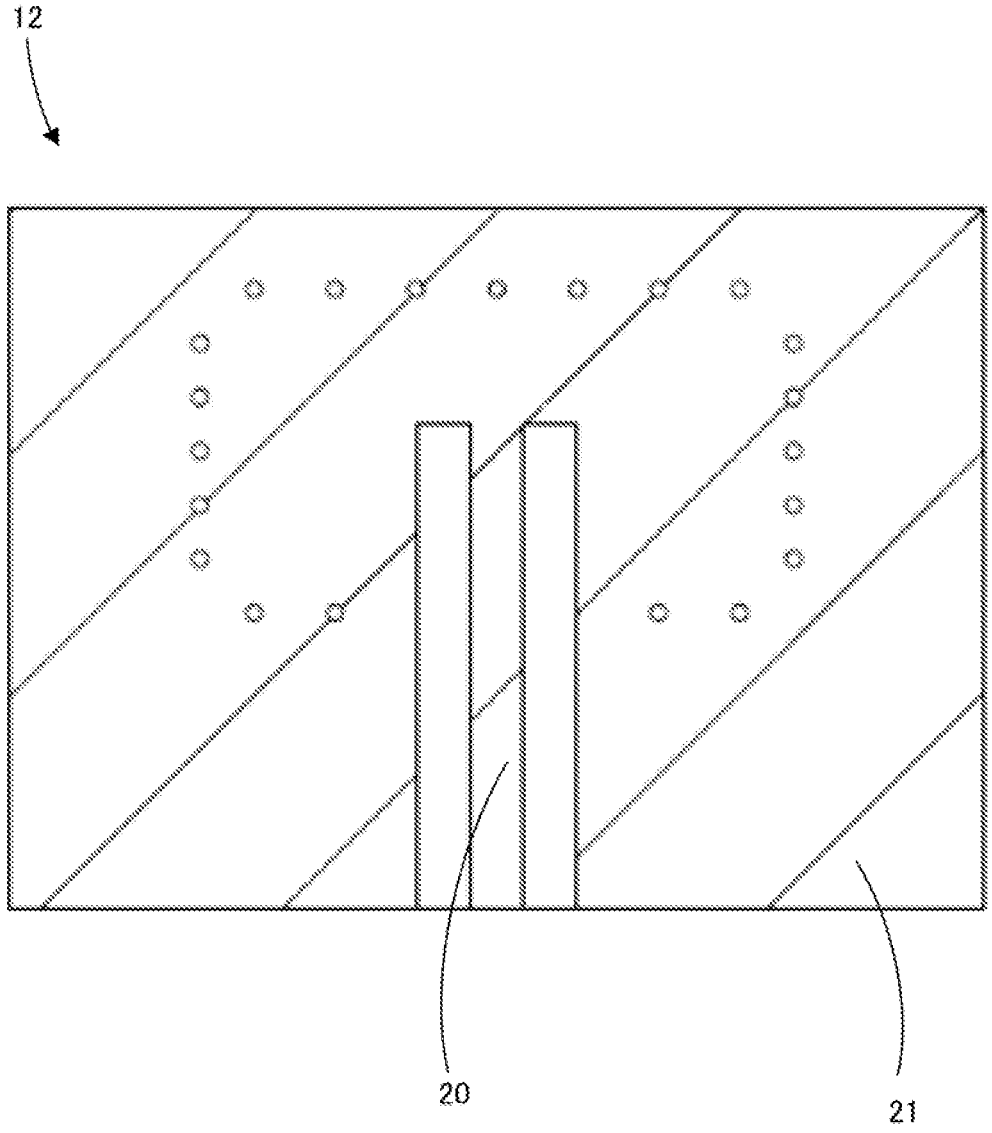
FIG. 5 is a planar view of a variation on the second conductor layer according to the second embodiment.

With the present embodiment, a second conductor layer 12 shown in FIG. 5 can be used in place of the second conductor layer 11. With this second conductor layer 12, the strip conductor 20 is connected at the tip thereof to the second grounding conductor 21 by a dielectric coupling, and is also connected to the antenna patterns 15 by a capacitance coupling.

Even when using this second conductor layer 12, the same effect as described above can be obtained.

Figure 6:
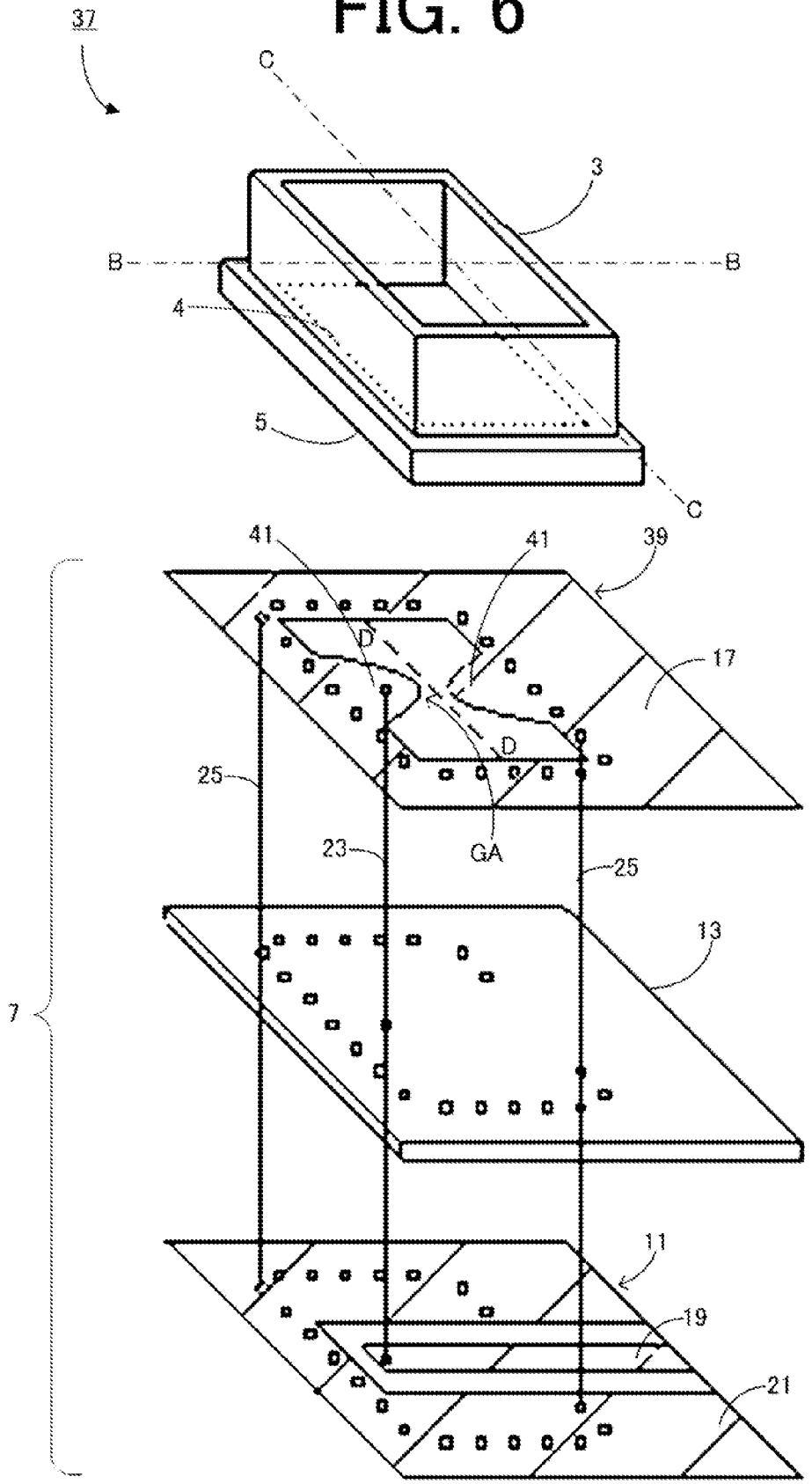
FIG. 6 is an exploded oblique view of the waveguide/planar line converter according to a third embodiment.
Figure 7:
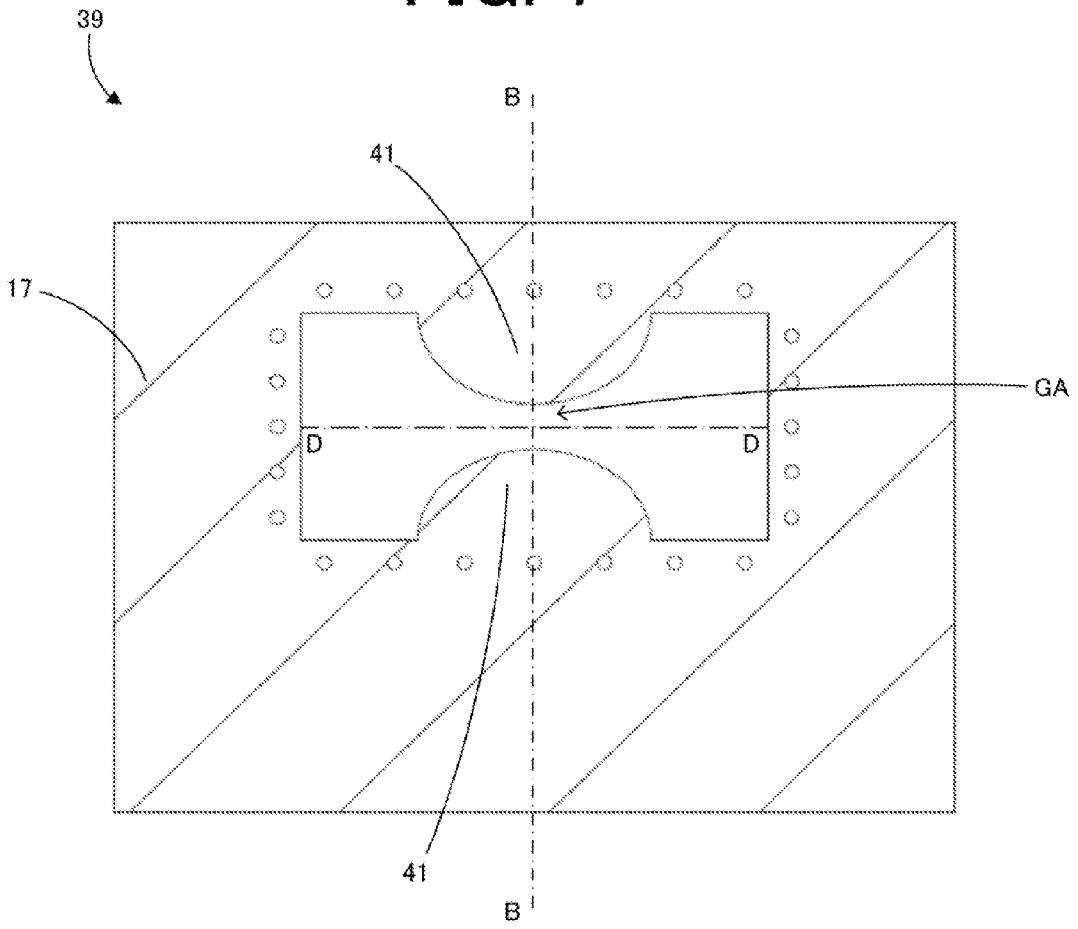
FIG. 7 is a planar view of a first conductor layer according to the third embodiment.

FIG. 6 is an exploded oblique view of the waveguide/planar line converter 37 according to a third embodiment. FIG. 7 is a planar view of a first conductor layer 39 according to the third embodiment.

With this embodiment, a semicircular pair of antenna patterns 41 each protruding toward the other, is provided on the first conductor layer 39 in place of the pair of antenna patterns 15. Through this, there is no angled part of the outer edge of the antenna patterns 41, so it is possible to reduce loss in the antennas.

Figure 8:
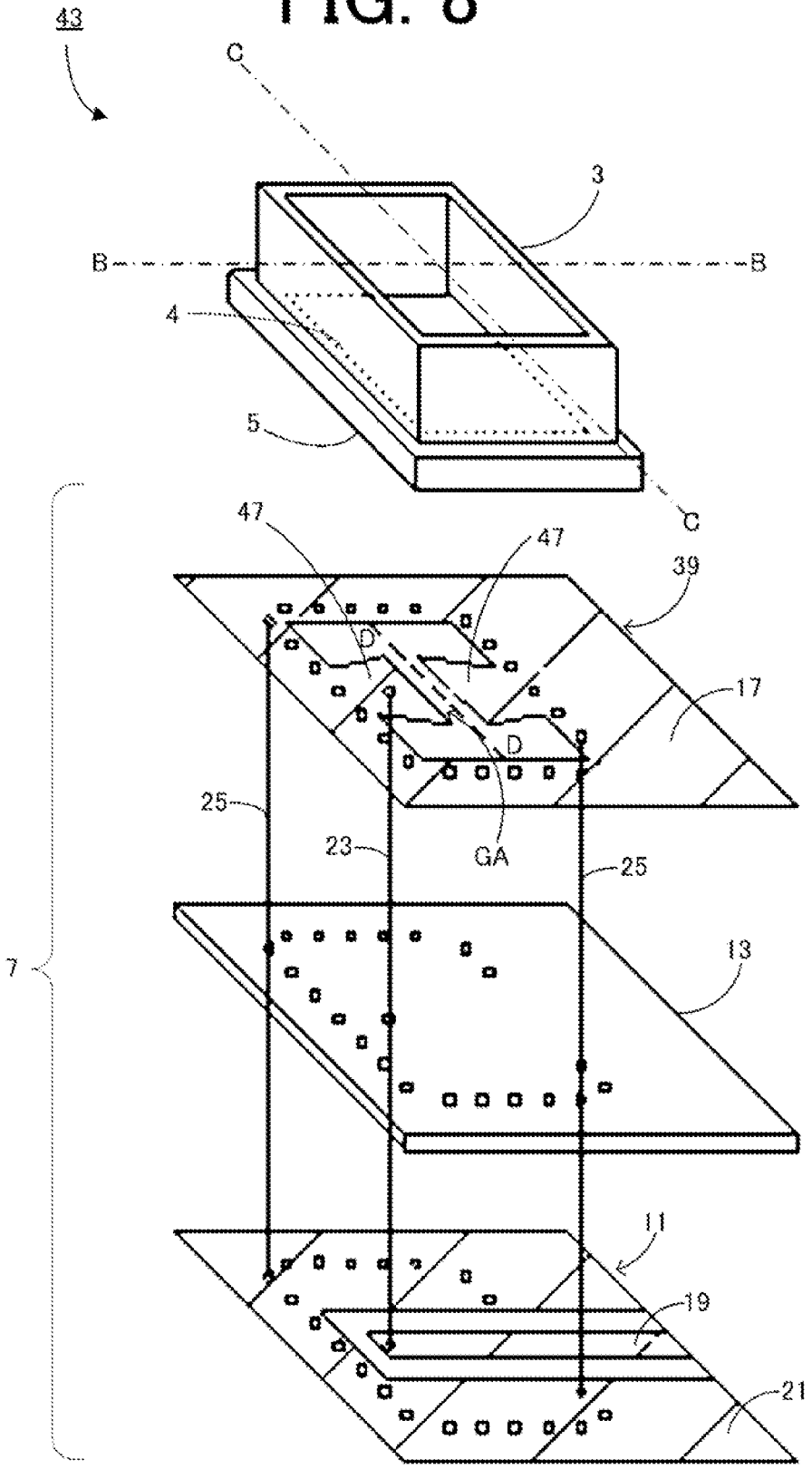
FIG. 8 is an exploded oblique view of the waveguide/planar line converter according to a fourth embodiment.
Figure 9:
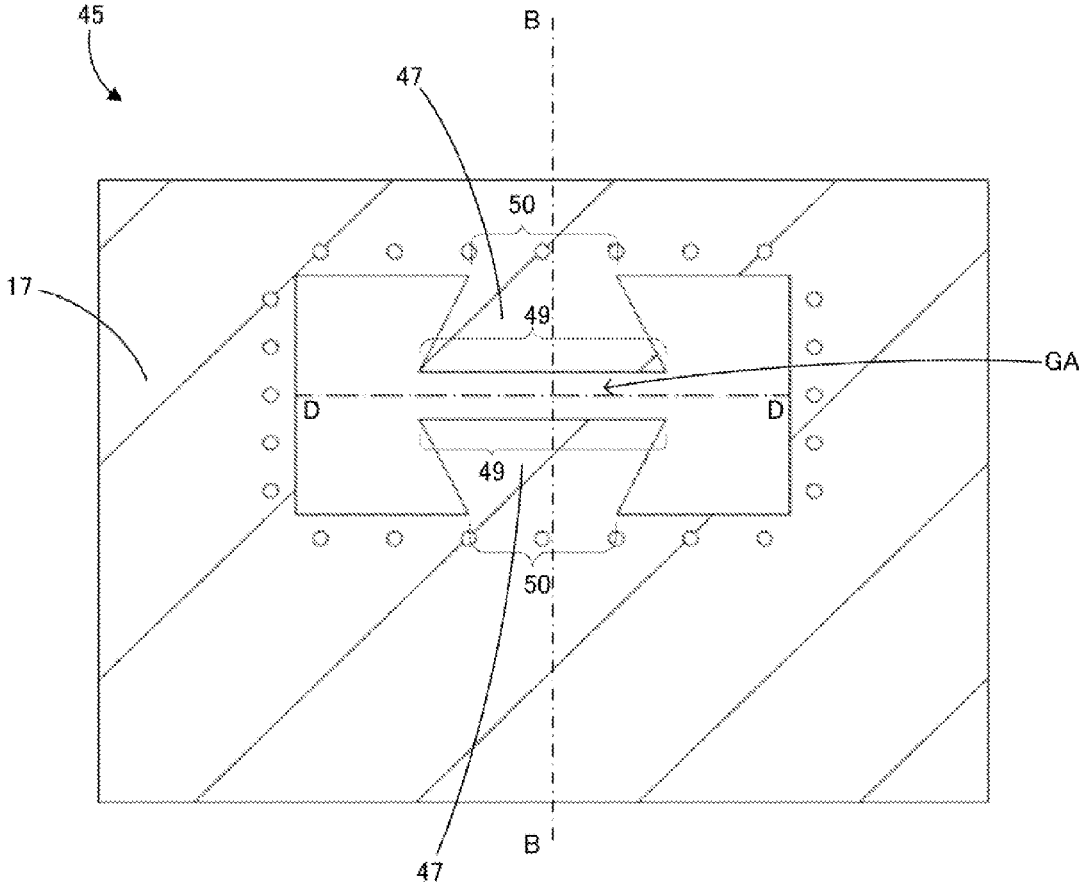
FIG. 9 is a planar view of a first conductor layer according to the fourth embodiment.

FIG. 8 is an exploded oblique view of the waveguide/planar line converter 43 according to a fourth embodiment. FIG. 9 is a planar view of a first conductor layer 45 according to the fourth embodiment.

With the present embodiment, a pair of antenna patterns 47, each of which has a shape that gradually narrows away from the other, such as a trapezoid, is provided on the first conductor layer 45 in place of the pair of antenna patterns 15. The width of the open ends 49 in these antenna patterns 47 is long compared to the width of the part 50 that contacts the first grounding conductor 17. In this manner, the resonant frequency of the resonant antennas comprising the antenna patterns 47 becomes shorter. In order to raise the resonant frequency, it is desirable for the width of the part 50 that contacts the first grounding conductor 17 to be made long in comparison to the width of the open ends 49, as opposite of the above. In addition, by regulating the width of the part 50 that contacts the first grounding conductor 17, it is possible to change the operating frequency of the waveguide/planar line converter.

Figure 10:
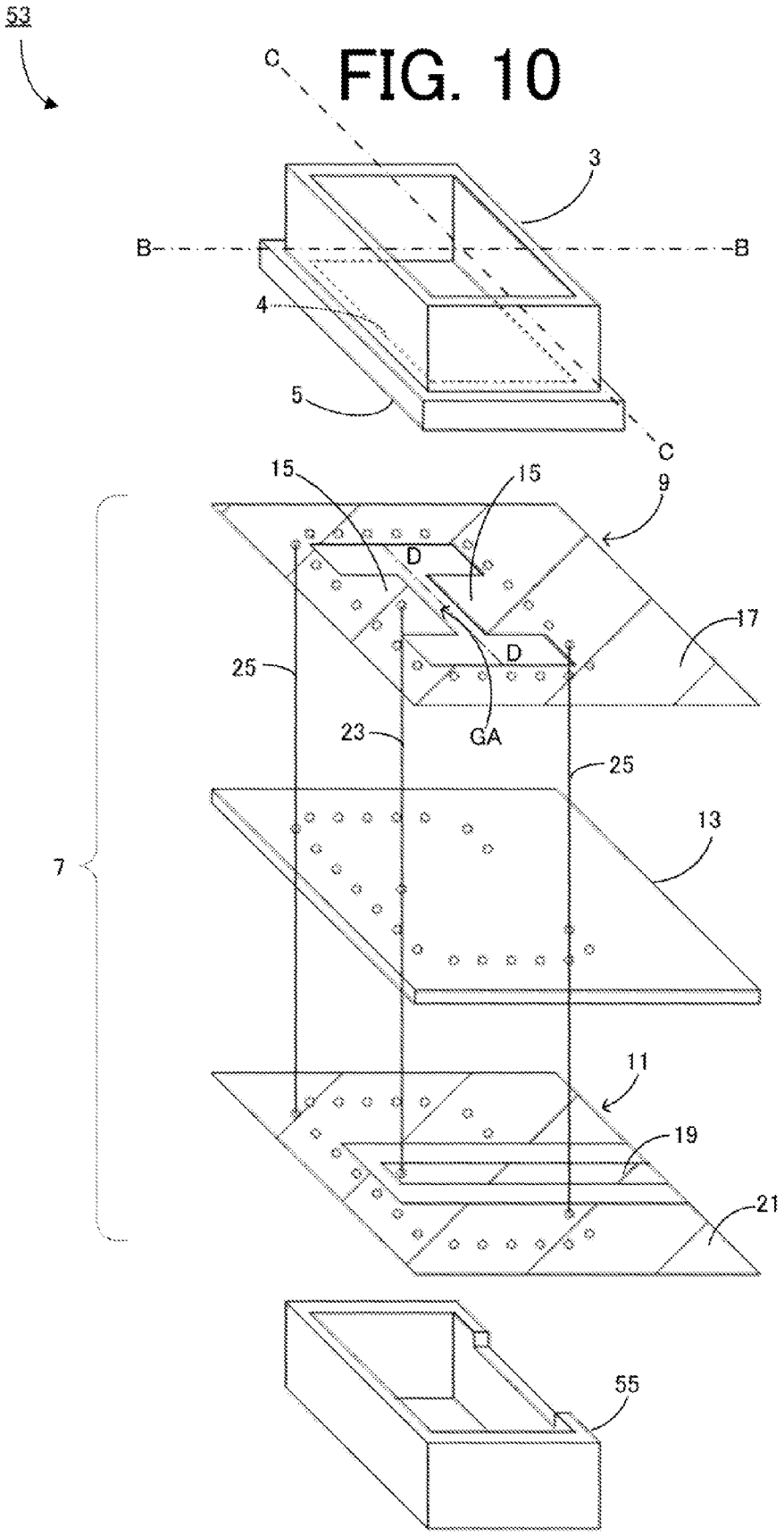
FIG. 10 is an exploded oblique view of the waveguide/planar line converter according to a fifth embodiment.

FIG. 10 is an exploded oblique view of the waveguide/planar line converter 53 according to a fifth embodiment.

The waveguide/planar line converter 53 according to this embodiment includes a shield cap 55 in addition to the configuration shown in FIG. 1. The shield cap 55 is positioned below the second conductor layer 11 and is connected to the second grounding conductor 21. With the present embodiment, leakage of electric power from the bottom surface of the second conductor layer 11 is prevented by the shield cap 55, so it is possible to avoid interference by this electric power with other elements of the planar circuit substrate.

Figure 11:
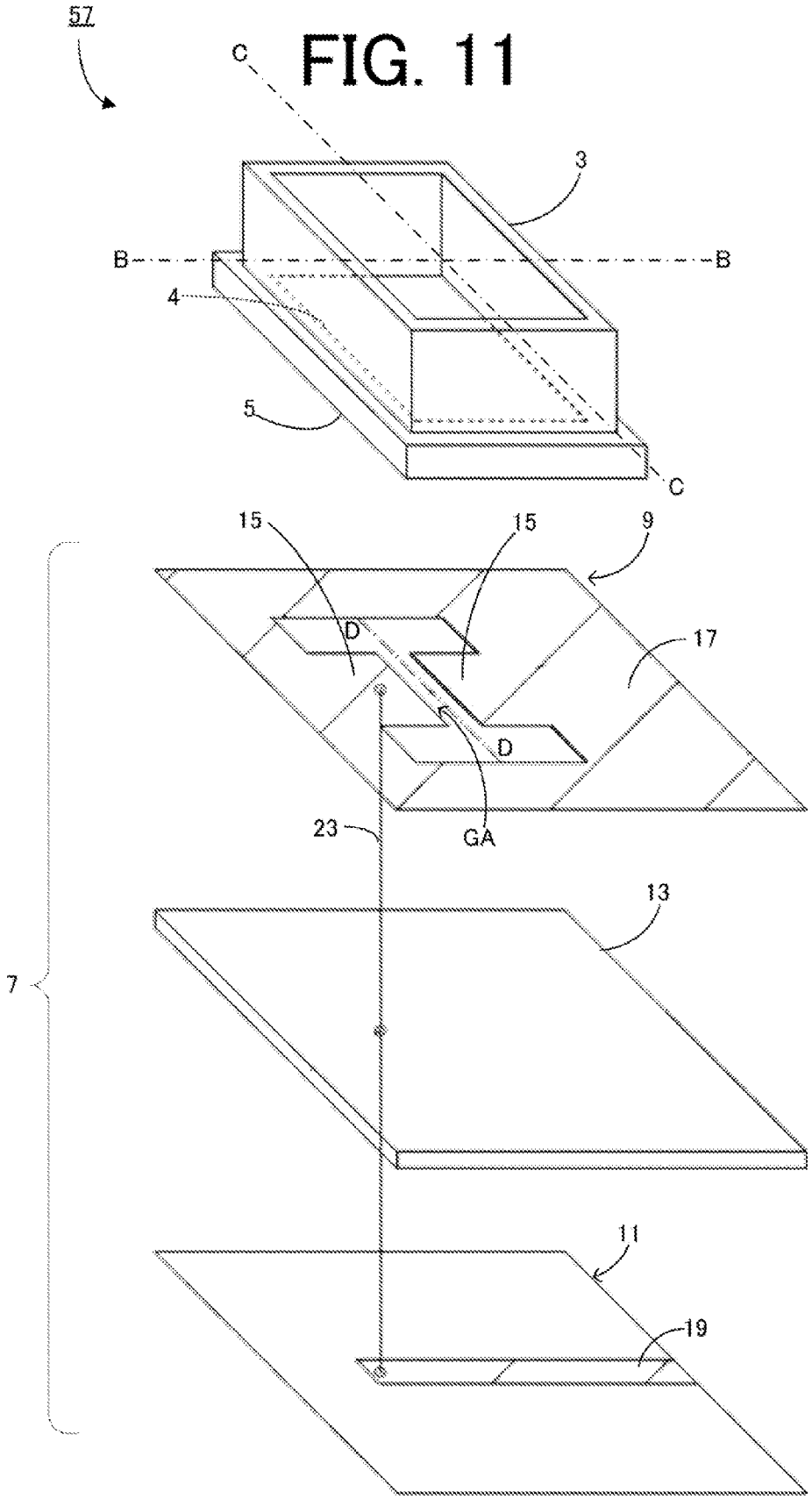
FIG. 11 is an exploded oblique view of the waveguide/planar line converter according to a sixth embodiment.

FIG. 11 is an exploded oblique view of the waveguide/planar line converter 57 according to a sixth embodiment.

In the waveguide/planar line converter 57 according to this embodiment, the second grounding conductor 21 and the via holes 25 are omitted from the configuration shown in FIG. 1. At this time, the transmission line in the strip conductor 19 is composed of a microstrip line and is connected to the antenna patterns 15 through the via holes 23. With the present embodiment, the structure of the waveguide/planar line converter is simplified.

Figure 12:
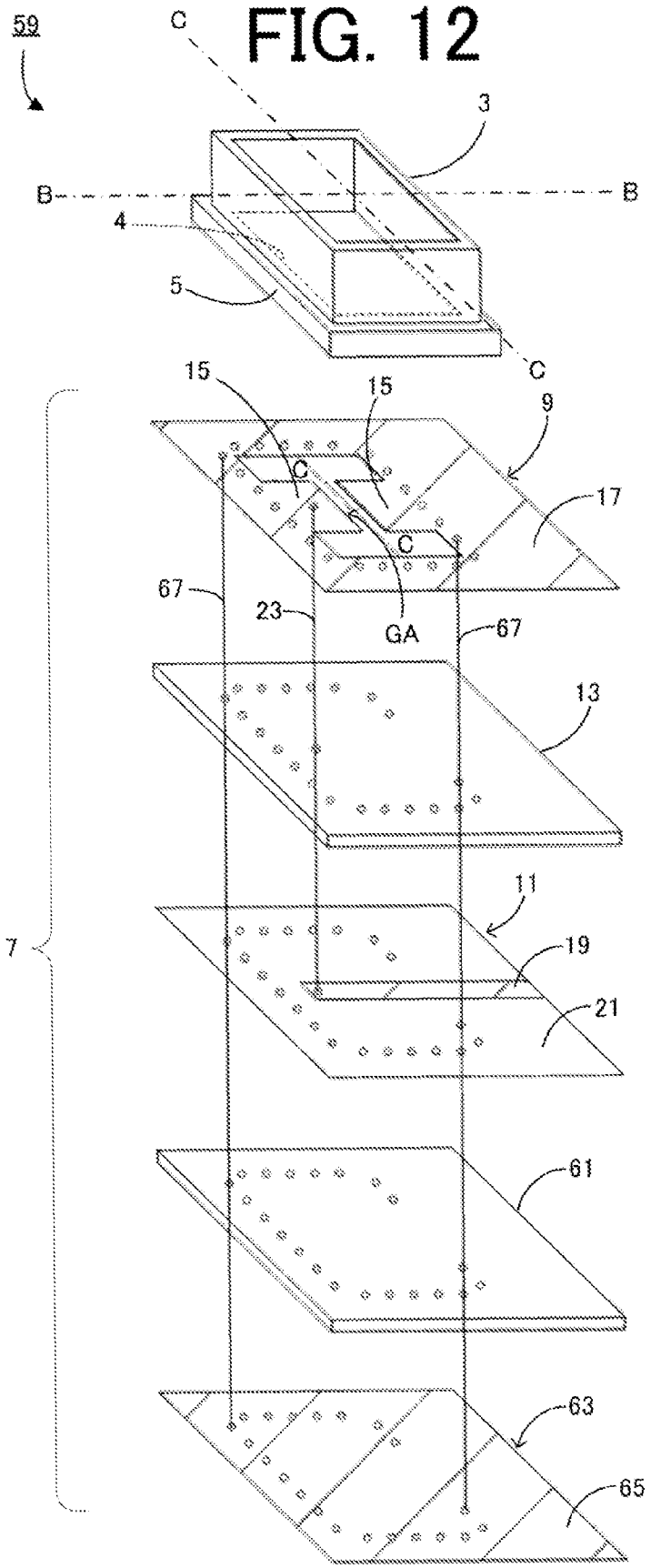
FIG. 12 is an exploded oblique view of the waveguide/planar line converter according to a seventh embodiment.

FIG. 12 is an exploded oblique view of the waveguide/planar line converter 59 according to a seventh embodiment.

The waveguide/planar line converter 59 according to this embodiment includes a dielectric body 61 positioned below the second conductor layer 11 and a third conductor layer 63 positioned below the dielectric body 61 in addition to the configuration shown in FIG. 1. In other words, the planar line substrate 7 is a single thin plate in which the topmost layer is composed of the first conductor layer 9, the bottommost layer is composed of the third conductor layer 63 and the intermediate layer between these is composed of the dielectric body 13, the second conductor layer 11 and the dielectric body 61.

A third grounding conductor 65 is formed on the third conductor layer 63. The first grounding conductor 17 of the first conductor layer 9 is connected to the third grounding conductor 65 through via holes 67 filled with a conductor and penetrating the dielectric bodies 13 and 61 in the direction of depth, and is composed as a triplate line with respect to the strip conductor 19.

With the present embodiment, the strip conductor 19 is interposed between the first grounding conductor 17 and the third grounding conductor 65, so that a transmission line in which leakage is suppressed is composed on the planar line substrate 7. In addition, the opening of the waveguide 3 is sealed by the planar line substrate 7, so the waveguide/planar line converter 59 is provided with airtight functionality.

In the waveguide/planar line converter according to the present invention, the planar line substrate, preferably, includes a laminated structure in the vertical direction; a first layer of the topmost layer of the planar line substrate includes a pair of antenna patterns positioned with a gap and positioned inside the opening end of the waveguide, and a first grounding conductor positioned surrounding the pair of antenna patterns and adhered and anchored to the opening end of the waveguide; a second layer positioned below the topmost layer of the planar line substrate includes a strip conductor which extends in a direction in which the pair of antenna patterns is lined, faces the pair of antenna patterns and is connected to the pair of antenna patterns, and a second grounding conductor positioned surrounding the strip conductor and connected to the first grounding conductor; and the pair of antenna patterns contacts the area positioned directly above the strip conductor, out of the areas of the first grounding conductor adhered and anchored to the opening end of the waveguide.

In addition, preferably the open ends of the pair of antenna patterns face each other via the gap, and the gap is positioned directly below the center line inside the waveguide in the widthwise direction.

In addition, preferably the strip conductor is connected to the antenna patterns via a capacitance bond.

In addition, preferably a dielectric body is positioned between the first layer and the second layer.

In addition, preferably the pair of antenna patterns comprises $\lambda/4$ resonant antennas.

In addition, preferably the pair of antenna patterns comprises resonant antennas having differing resonant frequencies.

This application is the National Phase of PCT/JP2010/050574, filed Jan. 19, 2010, which claims the benefit of Japanese Patent Application No. 2009-8868 filed on Jan. 19, 2009, the entire disclosure of which is incorporated by reference herein.

INDUSTRIAL APPLICABILITY

With the present invention, it is possible to realize a waveguide/planar line converter having superior conversion properties.

EXPLANATION OF SYMBOLS

1, 35, 37, 43, 53, 57, 59 waveguide/planar line converter
3 waveguide
4 opening
5 opening end
7 planar line substrate
9, 39, 45 first conductor layer
11, 12 second conductor layer
13, 61 dielectric body
15, 41, 47 antenna pattern
17, 51 first grounding conductor

19, 20 strip conductor
21 second grounding conductor
23, 25, 67 via holes
27 contact
31 open end
49 open end
55 shield cap
63 third conductor layer
65 third grounding conductor

The invention claimed is:

1. A waveguide/planar line converter comprising:

a waveguide; and a planar line substrate to which an opening end of said waveguide is adhered and anchored;

wherein a pair of antenna patterns is positioned facing each other with a gap in between and is positioned inside the opening end of said waveguide on said planar line substrate; and said waveguide and said pair of antenna patterns are positioned such that the position and direction of an electric field generated between said pair of antenna patterns match the position and direction of the maximum electric field inside said waveguide, wherein:

said planar line substrate includes a laminated structure in the vertical direction;

a first layer of the topmost layer of said planar line substrate includes a pair of antenna patterns positioned with a gap and positioned inside the opening end of said waveguide, and a first grounding conductor positioned surrounding said pair of antenna patterns and adhered and anchored to the opening end of said waveguide;

a second layer positioned below the topmost layer of said planar line substrate includes a strip conductor extending in a direction in which said pair of antenna patterns is lined, facing said pair of antenna patterns, and connected to said pair of antenna patterns, and a second grounding conductor positioned surrounding said strip conductor and connected to said first grounding conductor; and said pair of antenna patterns contacts the area positioned directly above said strip conductor, out of the areas of said first grounding conductor adhered and anchored to the opening end of said waveguide.

2. The waveguide/planar line converter according to claim 1, wherein the open ends of said pair of antenna patterns face each other via said gap; and said gap is positioned directly below the center line inside said waveguide in the widthwise direction.

3. The waveguide/planar line converter according to claim 1, wherein said strip conductor is connected to said antenna patterns via a capacitance coupling.

4. The waveguide/planar line converter according to claim 1, wherein a dielectric body is positioned between said first layer and said second layer.

5. The waveguide/planar line converter according to claim 1, wherein said pair of antenna patterns comprises $\lambda/4$ resonant antennas.

6. The waveguide/planar line converter according to claim 1, wherein said pair of antenna patterns comprises resonant antennas having differing resonant frequencies.

7. A waveguide/planar line converter, comprising:

a waveguide including an opening; and a substrate including a pair of antenna patterns and a planar line electrically connected to said pair of antenna patterns, and to which the opening end of said waveguide is attached;

wherein said pair of antenna patterns is positioned mutually facing each other with a gap in between on the inside of said opening end of said waveguide, wherein:

said opening end is rectangular;

said open ends of said pair of antenna patterns face each other via said gap; and said gap is positioned at a position overlapping a line connecting the center points of the short sides of said opening end.

8. The waveguide/planar line converter according to claim 7, wherein said pair of antenna patterns is formed in a shape line-symmetrical with respect to a line connecting said center points.

9. The waveguide/planar line converter according to claim 7, wherein said pair of antenna patterns is formed at a position overlapping a line connecting the center points of the long sides of said opening end.

* * * * *